US007066622B2

(12) United States Patent
Alessio

(10) Patent No.: US 7,066,622 B2
(45) Date of Patent: Jun. 27, 2006

(54) FLASHLIGHT

(75) Inventor: David J. Alessio, Amherst, OH (US)

(73) Assignee: Eveready Battery Company, Inc., St. Louis, MO (US)

( * ) Notice: Subject to any disclaimer, the term of this patent is extended or adjusted under 35 U.S.C. 154(b) by 128 days.

(21) Appl. No.: 10/916,724

(22) Filed: Aug. 12, 2004

(65) Prior Publication Data

US 2006/0034075 A1 Feb. 16, 2006

(51) Int. Cl.
*F21L 4/00* (2006.01)

(52) U.S. Cl. ..... 362/187; 362/277

(58) Field of Classification Search ..... 362/187, 362/277

See application file for complete search history.

(56) References Cited

U.S. PATENT DOCUMENTS 1,664,038 A * 3/1928 McEwing ..... 353/36
3,539,798 A * 11/1970 Perry ..... 362/308
4,988,188 A * 1/1991 Ohta ..... 353/122
5,595,435 A 1/1997 Palmer et al. ..... 362/109
5,630,661 A 5/1997 Fox ..... 362/187
6,290,368 B1 * 9/2001 Lehrer ..... 362/187
6,746,124 B1 * 6/2004 Fischer et al. ..... 353/43
2003/0038928 A1 * 2/2003 Alden ..... 353/122

FOREIGN PATENT DOCUMENTS

WO 04/001287 12/2003
WO 04/088199 10/2004

* cited by examiner

*Primary Examiner*—Ali Alavi
*Assistant Examiner*—Hargobind S. Sawhney
(74) *Attorney, Agent, or Firm*—Michael C. Pophal

(57) ABSTRACT

A flashlight that can be adjusted to provide different size light patterns at a predefined distance from the light is disclosed. The light patterns are always in-focus thereby providing well defined and uniformly illuminated areas of light. The focusing mechanism utilizes stationary lenses and a movable lens to adjust the diameter of the light pattern without allowing the pattern to become out of focus.

18 Claims, 4 Drawing Sheets

FLASHLIGHT

BACKGROUND OF THE INVENTION

This invention generally relates to portable light generating devices such as flashlights. More particularly, this invention relates to portable light generating devices that can be manually adjusted to provide in-focus patterns of light that have uniform light intensity throughout the illuminated area and a well defined edge where there is a crisp visual distinction between the illuminated area and the non-illuminated area.

Portable lighting devices, such as flashlights and lanterns, are commercially available in a wide array of embodiments. Some embodiments, particularly lanterns, are designed to produce a broad pattern of light that will illuminate a large area. Other embodiments, such as tubularly shaped flashlights, are intended to produce a narrow pattern of light that brightly illuminates a small area that must be closely inspected. Some flashlights and lanterns include a mechanism that can be used to change the pattern of light from broad to narrow and from narrow to broad as needed and are commonly known as "focusable lights". Many commercially available focusable lights incorporate an adjustable mechanism that fixes the position of the light bulb within the housing and relies upon movement of the reflector in relation to the light bulb in order to change the diameter of the pattern of light produced by the flashlight. Other focusable lights fix the position of the reflector within the body of the light and then move the light bulb relative to the reflector. Both of these embodiments produce inferior light patterns when adjusted because there is only one optimum location for a bulb relative to the reflector that will produce a pattern of light that is "in focus" thereby producing a well defined and uniform pattern of light at a specified distance from the light. As soon as the relative positioning of the bulb to the reflector is changed, such as when the light bulb is moved and the reflector remains stationary or the reflector is moved and the light bulb remains stationary, the light becomes out of focus and the light pattern becomes distorted. In particular, the perimeter of the light pattern becomes fuzzy or nonexistent. Furthermore, out of focus lights may produce dark spots within the light pattern that result in poor illumination of the object to be inspected.

Therefore, there remains a need for a focusable light that is always in focus thereby enabling the production of well defined patterns of light.

BRIEF SUMMARY OF THE INVENTION

The present invention provides a portable lighting device that be adjusted to provide in-focus patterns of light at a fixed distance from the light.

In one embodiment, this invention is a portable light generating device comprising a housing that defines an opening therethrough and has at least one battery disposed therein. A light emitting element, secured within the housing, is electrically coupled to the battery via an electrical circuit. A light pipe extends from at least the light emitting element to the opening in the housing. A first stationary lens is positioned within the light pipe between the light emitting element and the opening in the housing. A second stationary lens is positioned within the light pipe between the first stationary lens and the opening in the housing. An aperture defining component is positioned within the light pipe between the second stationary lens and the opening in the housing. A movable lens is positioned between the aperture defining component and the opening in the housing. The distance between the second stationary lens and the movable lens can be adjusted to sequentially project onto a surface, located at a predefined distance from the light generating device, at least a first in-focus pattern of light having a first diameter and a second in-focus pattern of light having a second diameter, wherein the first and second diameters are different.

DETAILED DESCRIPTION OF THE INVENTION

Figure 1:
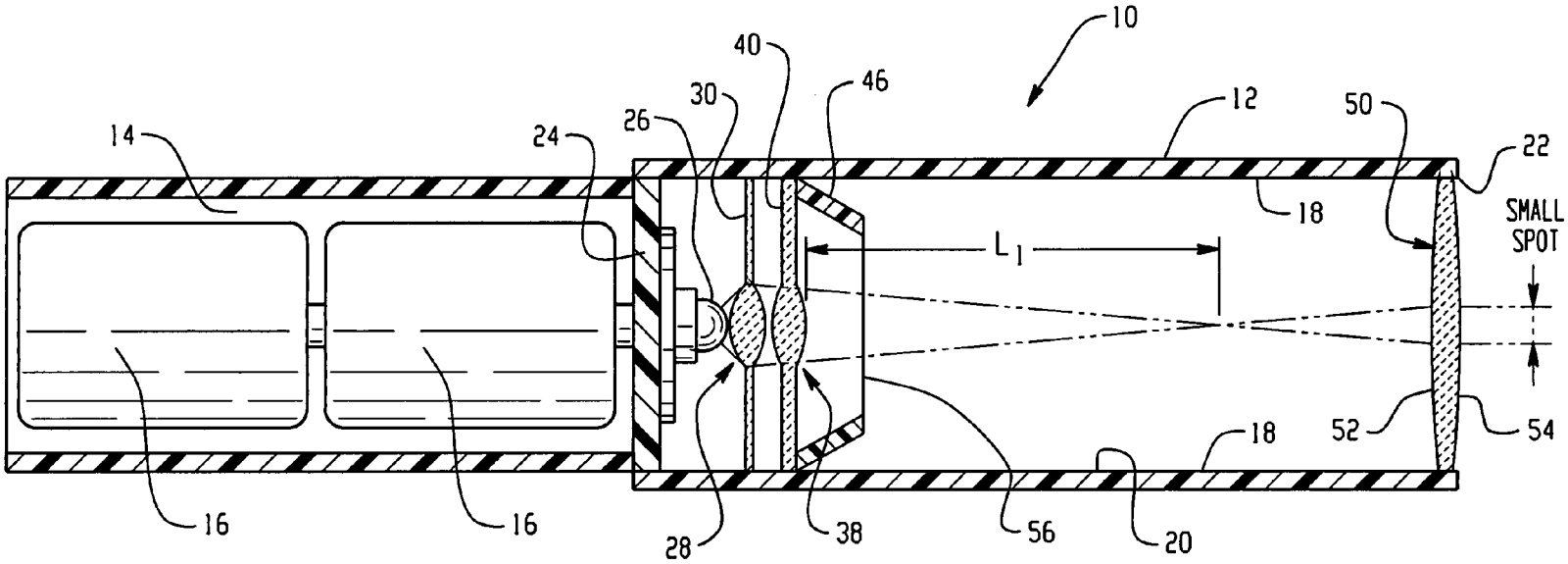
FIG. 1 is cross-sectional view of a portable light generating device of this invention showing the components arranged to produce a narrow diameter pattern of light.
Figure 4:
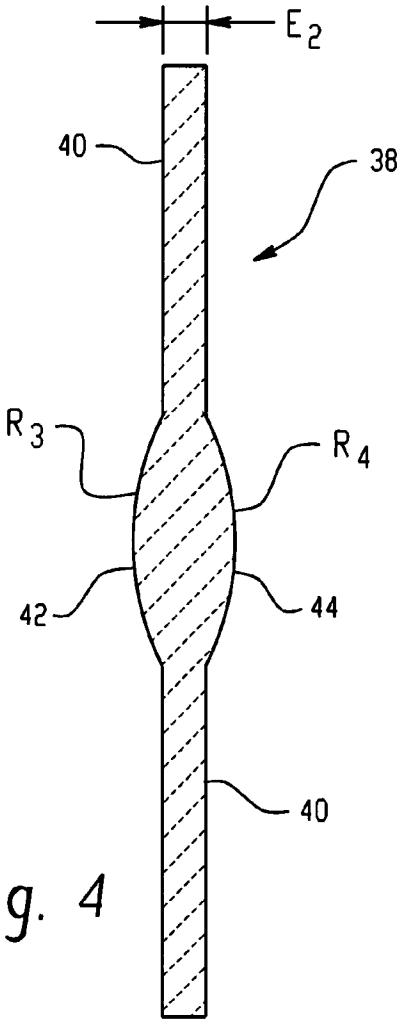
FIG. 4 shows a cross-sectional view of a second stationary lens having a planar portion and a double convex lens incorporated therein.
Figure 3:
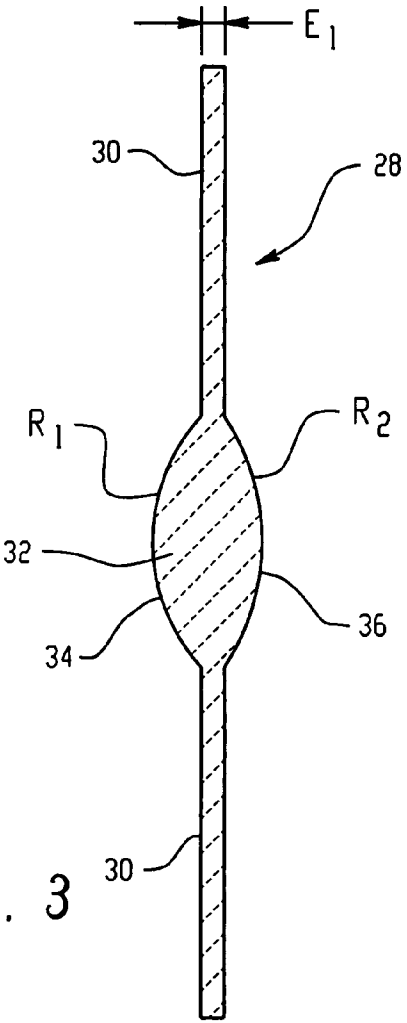
FIG. 3 shows a cross-sectional view of a first stationary lens having a planar portion and a double convex lens incorporated therein.
Figure 5:
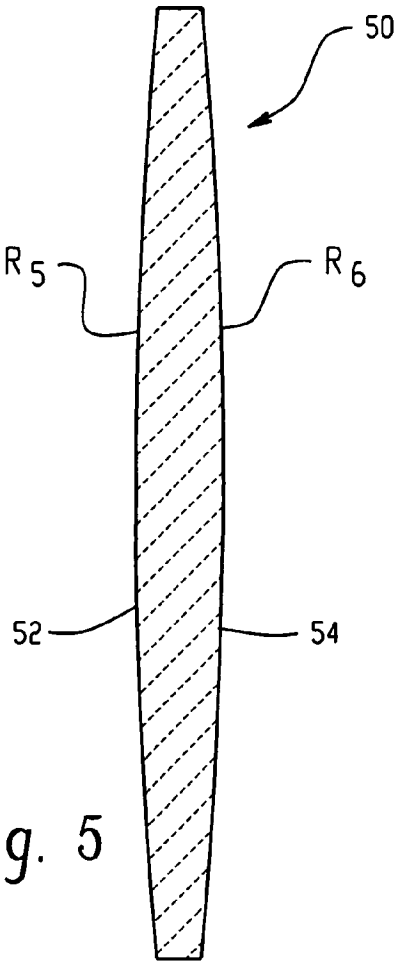
FIG. 5 shows a cross-sectional view of a movable lens having a planar portion and a double convex lens incorporated therein.

Referring now to FIG. 1, there is shown a cross-sectional view of a portable lighting device 10 of this invention. The device comprises a housing 12 that includes a battery containing compartment 14 with two batteries 16 secured therein. The housing is made of a molded plastic. A light pipe 18 occupies one end of the housing. The light pipe has an interior surface 20 that is highly reflective. The housing defines an opening 22 at one end of the light pipe. The end of the light pipe that is closest to the battery compartment contains a base member 24 to which light emitting element 26 is secured. A switch (not shown) forms part of an electrical circuit that connects the light emitting diode to the batteries. The light emitting element is mounted on the base member so that the light is directed toward the open end of the light tube. In some embodiments, the light emitting element produces heat which must be dissipated by the base member to the housing to avoid an undesirable buildup of heat within the housing. A first stationary lens 28 is located in the light pipe in close proximity to the light emitting element and on the opposite side of the light emitting element from the base member. As shown in FIG. 3, the first stationary lens has an outer planar portion 30 having a uniform edge thickness and a centrally located double convex lens 32. The edge thickness is defined herein as $E_1$. The first convex lens 34, which is located on the side of the stationary lens that is closest to the light emitting element, has a surface radius $R_1$. The opposite side of the first stationary lens has a second convex surface 36 incorporated therein with a surface radius $R_2$. As used herein, the surface radius of a lens may also be described as a radius of curvature. The first stationary lens' convex surfaces are concentrically aligned with one another. A second stationary lens 38 is located within the light pipe between the first stationary lens and the opening in the housing. FIG. 4 is a cross-sectional view of second stationary lens 38. The second stationary lens has an outer planar portion 40 having a uniform edge thickness $E_2$, a first convex surface 42 with a surface radius $R_3$ and a second convex surface 44 with a surface radius $R_4$. The second stationary lens' convex surfaces are concentrically aligned with the first stationary lens' convex surfaces. An aperture defining component 46 is positioned within the light pipe between the second stationary lens and the opening in the housing. A movable lens 50, located within the light pipe, is positioned between the aperture defining component and the opening in the housing. As shown in FIG. 5, the movable lens has a first convex surface 52 having a surface radius $R_5$ and a second convex surface 54 having a surface radius $R_6$.

The aperture defining component defines aperture 56. The function of the aperture defining component is to prevent stray light from producing one or more undesirable "rings" of light in the device's light pattern that may exist if the aperture defining component were not in place. Aperture 56 must be concentrically aligned with the stationary lenses' and the movable lens' convex surfaces.

The physical features and configuration of the stationary lenses and movable lens will now be described in greater detail. First stationary lens 28 includes first convex surface 34, having a radius $R_1$ and second convex surface 36 having a radius $R_2$. To insure that the light from the light emitting element is focused toward the center of the light pipe, the surface curvatures of lens 28 are selected so that the radius of $R_1$ is less than the radius of $R_2$. Second stationary lens 38 has a first convex surface 42, having a radius $R_3$, and a second convex surface 44, having a radius $R_4$. To properly focus the light from the light emitting element that has passed through the first stationary lens onto the second stationary lens, the surface curvatures of the second stationary lens' first and second surfaces must be greater than the surface radii of the first stationary lens' second convex surface $R_2$. If desired, radius $R_3$ of convex surface 42 may be equal to radius $R_4$ of convex surface 44. Movable lens 50 has a first convex surface 52, having a radius $R_5$, and a second convex surface 54, having a surface radius $R_6$. To provide the desired in-focus adjustability of the lighting device's projected light, surface radii $R_5$ and $R_6$ of movable lens 50 must be greater than the radius of either surface radius of second stationary lens 38. Surface radii $R_5$ and $R_6$ may be equal to one another.

Figure 6:
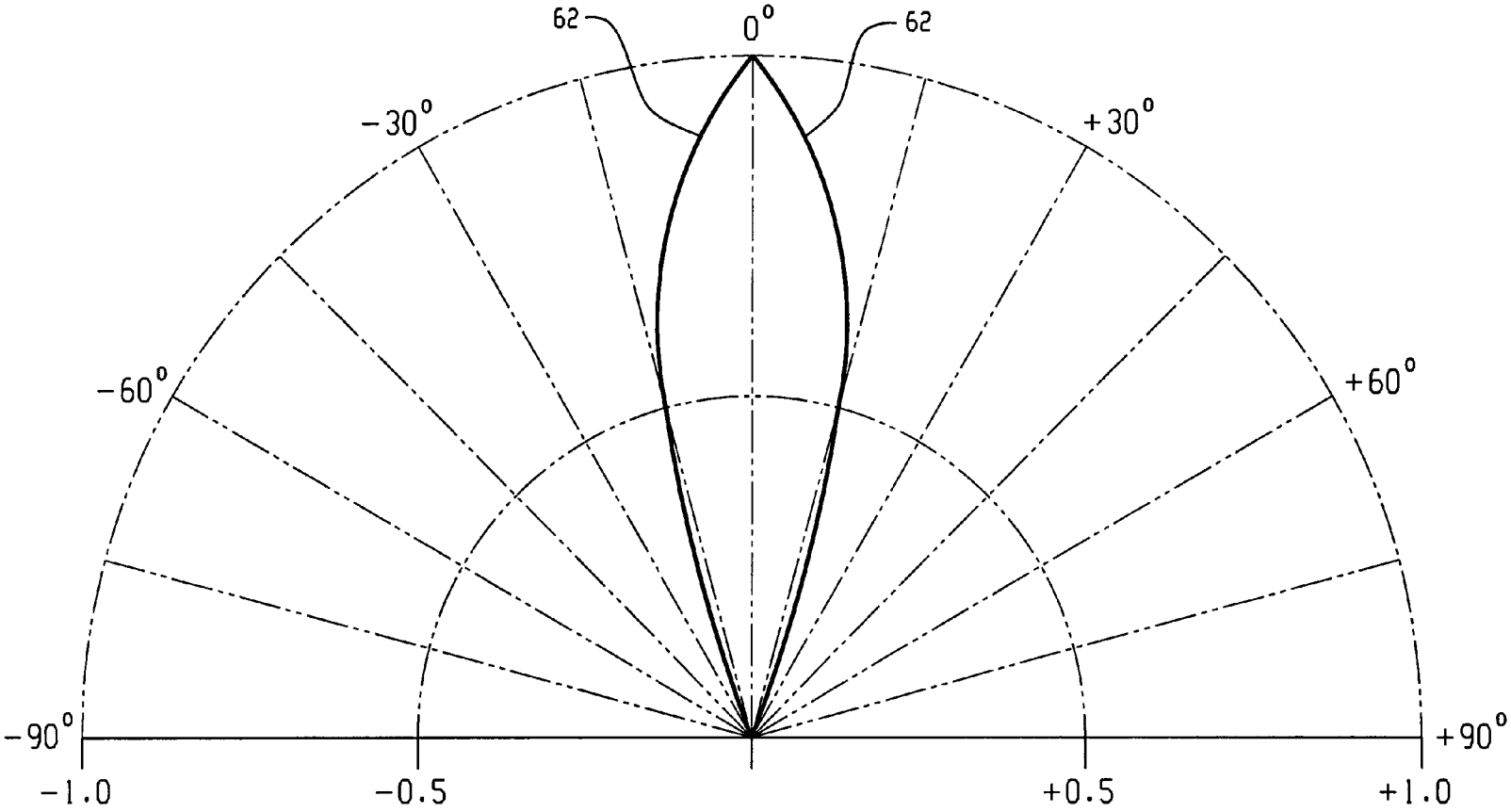
FIG. 6 is a graph showing the angle of directivity for a light emitting diode.

Light emitting diodes (LEDs) which are suitable as the light emitting element in a portable lighting device of this invention, can be manufactured with a narrow angle of directivity, a broad angle of directivity or somewhere therebetween. FIG. 6 is a graph showing an LED's angle of directivity. The intensity of the LED is plotted on the horizontal axis and can vary from +1.0 to −1.0. The angle of directivity varies from +90° to −90°. Curved lines 62 in FIG. 6 represent a light emitting diode with a 30° angle of directivity at 50% intensity. An LED with an angle of directivity of 140° or less is recommended for use in a lighting device of this invention. LEDs with larger angles of directivity may also be useful. The light emitting element's angle of directivity is a significant factor that must be considered when selecting the radii of the first stationary lens' convex surfaces. The objective is to select an LED and lens combination that will maximize the amount of light passing through the lens thereby minimizing the amount of stray light that does not pass through the lens. Preferably, at least 90% of the LED's light output passes through the first stationary lens' curved surfaces. More preferably, at least 95% of the LED's light output passes through the first stationary lens' curved surfaces.

Figure 2:
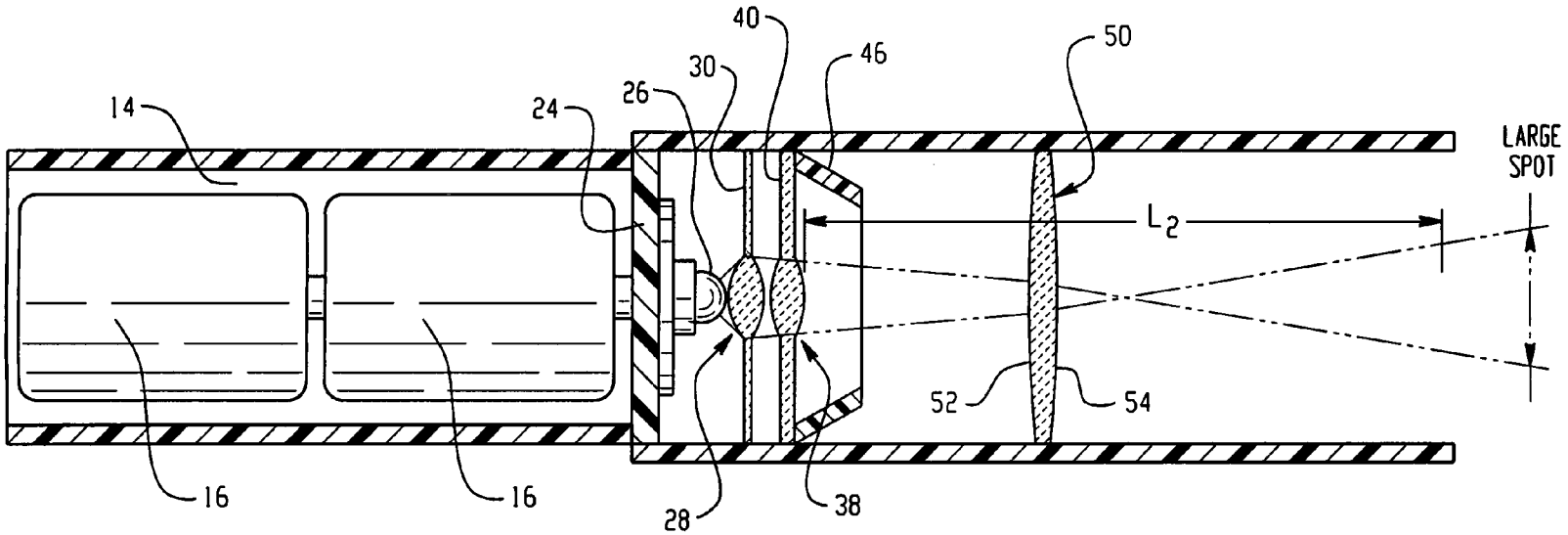
FIG. 2 is cross-sectional view of a portable light generating device of this invention showing the components arranged to produce a broad diameter pattern of light.

A preferred arrangement of the light emitting element, light pipe, first stationary lens, second stationary lens, aperture defining component and movable lens will now be described. To achieve optimum performance, the light emitting element, both stationary lenses, the movable lens and the aperture defining component must all be located within the light pipe. Preferably, the light pipe has a constant diameter and the light emitting element is a light emitting diode (LED). Because the light emitting element and first stationary lens are located in close proximity to one another, the first stationary lens has a double convex lens located only in the central portion of the lens. The outer portion of the stationary lens, through which very little light from the light emitting element passes, has a uniform thickness thereby forming a planar portion surrounding the double convex lens portion. Similar to the first stationary lens, the second stationary lens also has a centrally located double convex lens surrounded by a planar portion. As the light from the light emitting diode passes through the first stationary lens, the light rays converge. As shown in FIG. 1, when the converging rays of light exit the first stationary lens, the light is made to pass through the second stationary lens which causes the light rays to converge toward the focal point of the system which is located at a distance $L_1$ from the second stationary lens' second surface. The system's focal point must be located within the length of the light pipe that extends beyond the second stationary lens, which is designated $L_2$ in FIG. 2, so that the movable lens can be positioned (a) between the focal point and the opening in the end of the light pipe, as shown in FIG. 1, or (b) between the second stationary lens and the focal point, as shown in FIG. 2. The movable lens could also be positioned at the focal point. Determining the location of the system's focal point involves calculating the location at which light rays exiting the first lens and impinging upon the first surface of the second stationary lens and then exiting the second stationary lens' second surface will converge into a small area commonly known as the system's focal point. As is known in the art, many physical parameters impact the location of the focal point. Some of these parameters include: the lenses' radii of curvature, the center thicknesses of the lenses, the edge thicknesses of the lenses and the angle at which light first strikes a lens.

Some of the factors that must be considered when designing a portable lighting device with an adjustable spot that is always in-focus, are the radii of the curved surfaces on the first stationary lens, second stationary lens and movable lens. The lenses' radii must be selected to cooperate with one another to cause the rays of light to form an "in-focus" pattern of light that can be adjusted by the consumer to create well defined patterns of light that can be varied from a first or minimum diameter, designated herein as $D_{min}$, to an equally well defined and in-focus pattern of light having a second or maximum diameter, designated herein as $D_{max}$, while maintaining the light at a predefined distance from a surface, such as a wall, onto which the light pattern is projected. Preferably, the ratio of $D_{max}$ to $D_{min}$ is at least 2.0:1.0. More preferably, the ratio is at least 3.0:1.0. The radius of the first stationary lens' first convex surface, designated herein as $R_1$, must be smaller than the radius of the first stationary lens' second surface which is designated herein as $R_2$. Similarly, the radius of the second stationary lens' first convex surface, identified herein as $R_3$, must be equal to or smaller than the radius of the second stationary lens' second convex surface which is known herein as $R_4$. The radius of the movable lens' first convex surface, $R_5$, must be greater than the radius $R_4$ of the second stationary lens' second curved surface. Finally, the radius of the movable lens' second curved surface, known herein as $R_6$, must be equal to or greater than the radius, $R_5$, of the movable lens' first convex surface. The exact values of each lens' radii can be altered to accommodate design differences, such as the diameter of the light pipe or angle of directivity of the light emitting diode, but the relationship of one curved surface's radius to an adjoining curved surface's radius must be maintained to insure optimum performance of the light.

The portion of the light pipe that extends beyond the second stationary lens towards the open end of the light pipe must be selected to insure that the movable lens can be adjusted from a first position to a second position, wherein, in the first position, the distance from the second stationary lens' second curved surface to the movable lens' first curved surface is greater than $L_1$ and in the second position the distance from the second stationary lens' second curved surface to the movable lens' first curved surface is less than $L_1$. The ability to adjust the location of the movable lens to a first position and a second position, as described above, is necessary to achieve the desired goal of altering the diameter of a well defined light pattern while maintaining the light source at a predefined distance from the surface onto which the light is projected.

The structure of the adjustment mechanism used to reposition the movable lens within the light pipe is not critical to the successful functioning of the lighting device provided the movable lens always remains perpendicular to the light pipe's longitudinal axis. An example of a suitable lens adjusting mechanism is disclosed in WO 04/001287 which published on Dec. 31, 2003.

In a preferred embodiment, a light generating device of this invention uses the following components. The housing is made from plastic that has been injection molded to the desired shape and size. The light emitting element is a Luxeon™ LED which is available from Lumileds Inc. of San Jose, Calif., USA. A three watt LED is preferred but a one watt LED is suitable. The stationary lenses and movable lens are made from polycarbonate. The light pipe has a 30 mm inside diameter and is 75 mm in length. Other suitable materials from which the lenses may be made include K-resin, polystyrene and glass. To facilitate manufacturing of the movable lenses and the stationary lens, the ratio of the thickness of the double convex lens to the thickness of the same lens' edge thickness should be 3:1 or less. The radii of the first stationary lens' first curved surface and second curved surface are 6 mm and 10 mm, respectively. Both the second stationary lens' first curved surface and second curved surface have an 11.38 mm radius. The diameter of the stationary lenses' curved surfaces is 9 mm. The edge thickness of the first stationary lens is 1.0 mm and the edge thickness of the second stationary lens is 1.6 mm. The movable lens' first and second curved surfaces have a 76.67 mm radius. The edge thickness of the movable lens is 2 mm. The overall diameter of the first stationary lens, the second stationary lens and the movable lens is 30 mm which is equal to the inside diameter of the light pipe. The aperture defining component defines an 18 mm diameter opening. The movable lens can be moved 42 mm along the length of the light tube thereby enabling the light to project an in-focus pattern of light having a 23 cm diameter or an in-focus pattern of light having an 81 cm diameter when the light generating device is located 1.5 m from a flat surface positioned perpendicular to the light pipe and onto which the light is projected. As the diameter of the light is changed, the diameter of the light pattern and the intensity of the light are inversely proportional to one another.

The above description is considered that of the preferred embodiments only. Modifications of the invention will occur to those skilled in the art and to those who make or use the invention. Therefore, it is understood that the embodiments shown in the drawings and described above are merely for illustrative purposes and are not intended to limit the scope of the invention, which is defined by the following claims as interpreted according to the principles of patent law, including the Doctrine of Equivalents.

I claim:

1. A portable light generating device, comprising:

(a) a housing defining an opening therethrough and having at least one battery disposed therein;

(b) a light emitting element secured within the housing and electrically coupled to said battery via an electrical circuit;

(c) a light pipe extending from at least said light emitting element to the opening in said housing;

(d) a first stationary lens positioned within said light pipe between said light emitting element and the opening in said housing;

(e) a second stationary lens positioned within said light pipe, said second stationary lens located between said first stationary lens and the opening in said housing;

(f) an aperture defining component positioned within said light pipe between said second stationary lens and the opening in said housing; and (g) a movable lens positioned between said aperture defining component and the opening in said housing, wherein the distance between the second stationary lens and the movable lens can be adjusted to sequentially project onto a surface, located at a predefined distance from said light generating device, at least a first in-focus pattern of light having a first diameter and a second in-focus pattern of light having a second diameter, wherein said first and second diameters are different.

2. The portable light generating device of claim 1 wherein said light pipe has a constant inside diameter.

3. The portable light generating device of claim 1 wherein said first stationary lens has a first convex surface, located on the side of said first stationary lens that is closest to said light source, and a second convex surface, located on the side of said first stationary lens that is furthest from said light source, said convex surfaces each having a surface radius, wherein the surface radius of said first convex surface is less than the surface radius of said second convex surface.

4. The portable light generating device of claim 1 wherein said second stationary lens has a first convex surface and a second convex surface, wherein said second stationary lens' convex surfaces have surface radii that are greater than said first stationary lens' surface radii.

5. The portable light generating device of claim 4 wherein the surface radii of said second stationary lens' first and second convex surfaces are the same.

6. The portable light generating device of claim 1 wherein said movable lens has a first convex surface and a second convex surface, said movable lens' convex surfaces each having a surface radius, wherein the surface radii of said movable lens' convex surfaces are greater than the surface radii of said second stationary lens' convex surfaces.

7. The portable light generating device of claim 1 wherein said aperture defining component comprises a circular aperture.

8. The portable light generating device of claim 1 comprises a base member to which said light emitting element is secured.

9. The portable light generating device of claim 8 wherein said light emitting element generates heat and said base member dissipates the heat.

10. The portable light generating device of claim 1 wherein said stationary lenses each comprise a planar portion having a uniform edge thickness and a centrally located portion having double convex surfaces, said double convex surfaces concentrically aligned with one another and defining a center thickness.

11. The portable light generating device of claim 10 wherein the ratio of said center thickness to said edge thickness is three or less.

12. The portable light generating device of claim 1 wherein said light emitting element is a light emitting diode.

13. The portable light generating device of claim 12 wherein said light emitting diode generates a light pattern having an angle of directivity of ±70° or less.

14. The portable light generating device of claim 1 wherein said electrical circuit comprises a switch.

15. The portable light generating device of claim 1 wherein the diameter of said first light pattern and the intensity of light in said first light pattern are inversely proportional to one another.

16. The portable light generating device of claim 1, wherein the second stationary lens focuses light from the light emitting diode onto a focal point and said movable lens can be sequentially positioned within said light pipe between said second stationary lens and the focal point, at the focal point, and between the focal point and the opening in said housing.

17. The portable light generating device of claim 1, wherein the ratio of said first diameter to said second diameter is at least 2.0:1.0 when the distance from the light generating device's opening and said surface is 1.5 m.

18. The portable light generating device of claim 17, wherein said ratio is at least 3.0:1.0.

* * * * *